US007585176B2

(12) United States Patent
Chen et al.

(10) Patent No.: US 7,585,176 B2
(45) **Date of Patent: *Sep. 8, 2009**

(54) CONNECTOR ENCOMPASSING 15-PIN HIGH DENSITY D-SUB PINOUT HAVING ADDITIONAL PIN CAPACITY

(75) Inventors: Sun-Chung Chen, Taipei Hsien (TW); Chang-Yu Chung, Taipei Hsien (TW)

(73) Assignee: ATEN International Co., Ltd., Hsichi, Taipei Hsien ( * ) Notice: Subject to any disclaimer, the term of this patent is extended or adjusted under 35 U.S.C. 154(b) by 0 days.

This patent is subject to a terminal disclaimer.

(21) Appl. No.: 11/808,329

(22) Filed: Jun. 8, 2007

(65) Prior Publication Data

US 2007/0243767 A1 Oct. 18, 2007

Related U.S. Application Data

(63) Continuation-in-part of application No. 10/813,066, filed on Mar. 31, 2004, now Pat. No. 7,281,067.

(51) Int. Cl.
*H01R 4/60* (2006.01)

(52) U.S. Cl. ..... 439/222; 439/639; 439/505

(58) Field of Classification Search ..... 439/639, 439/172–173, 222, 505, 685–686
See application file for complete search history.

(56) References Cited

U.S. PATENT DOCUMENTS

| | | | | |
|---|---|---|---|---|
| 4,687,275 | A * | 8/1987 | Ramisch et al. | 439/404 |
| RE37,296 | E * | 7/2001 | Peterson | 439/677 |
| 6,609,034 | B1 | 8/2003 | Behrens et al. | |
| 6,671,756 | B1 | 12/2003 | Thomas et al. | |
| 6,948,980 | B2 * | 9/2005 | Xiang et al. | 439/607 |
| 7,035,112 | B2 | 4/2006 | Chen et al. | |
| 7,281,067 | B2 * | 10/2007 | Chen | 710/62 |
| 7,448,917 | B2 * | 11/2008 | Liao et al. | 439/660 |
| 2002/0084988 | A1 | 7/2002 | Kuo | |
| 2003/0188049 | A1 | 10/2003 | Dickens | |
| 2004/0088468 | A1 | 5/2004 | Hasegawa | |
| 2005/0066000 | A1 | 3/2005 | Liaw et al. | |
| 2005/0138245 | A1 | 6/2005 | Chen | |

* cited by examiner

*Primary Examiner*—Briggitte R Hammond
*Assistant Examiner*—Vanessa Girardi
(74) *Attorney, Agent, or Firm*—Patterson & Sheridan, LLP; Keith P. Taboada

(57) ABSTRACT

An electrical connector includes a group of first electrical terminals and at least one second electrical terminal. The group of first electrical terminals is arranged in three rows, and the first electrical terminals in one of the three rows are separate from each other in a first pitch. The second electrical terminal is separate from an outmost first electrical terminal in the group of first electrical terminals in a second pitch.

23 Claims, 9 Drawing Sheets

CONNECTOR ENCOMPASSING 15-PIN HIGH DENSITY D-SUB PINOUT HAVING ADDITIONAL PIN CAPACITY

CROSS REFERENCE TO RELATED APPLICATIONS

The present Application for Patent is a continuation-in-part of application Ser. No. 10/813,066, filed Mar. 31, 2004, now U.S. Pat. No. 7,281,067.

BACKGROUND

1. Field of Invention

The present invention relates to electrical connectors. More particularly, the present invention relates to extended electrical connectors which increases pin density of the typical high-density D-SUB connectors.

2. Description of Related Art

A conventional D-Sub electrical connector comprises an insulative housing having a D-shaped mating portion and a plurality of terminals received in the housing. A metal shell often surrounds a substantial portion of the housing to protect at least the mating portions of the contacts from RF (Radio Frequency) and EMI (Electro Magnetic Interference) as well as to protect the surrounding from interference radiating from the connector, itself.

Conventionally, a high-density D-SUB connector of the typical type is ruled to have 15 terminals, such as 15 contacts of the high-density D-SUB female connector or 15 pins of the high-density D-SUB male connector. However, the limited terminal number of the high-density D-SUB connector sometimes is still not enough to transmit various kinds of signals provided for different functions in addition to video displaying. Moreover, each terminal of the high-density D-SUB connector, corresponding to in its position, has been defined to transmit signals of a fixed function according to the D-SUB connector standard. It is complicated and difficult to compress other signals into the signals of which the functions are well defined and limited by the terminal positions.

Hence, it is desirable to have an extended electrical connector to overcome the above-mentioned disadvantages of the prior art.

SUMMARY

According to one embodiment of the present invention, an electrical female connector comprises an insulative housing and a plurality of contacts. The insulative housing comprises a base portion, a mating portion and a plurality of passageways. The base portion has a rear terminating face. The mating portion extends from the base portion. Two opposite sides of the mating portion are not parallel and have different lengths. The passageways extend through the rear terminating face and the mating portion. The contacts are received in the passageways, respectively, and the contacts are adapted for electrically connecting a complementary connector.

According to another embodiment of the present invention, an electrical male connector comprises a substrate and a plurality of pins. The pins are mounted on the substrate, and a number of the pins is greater than 15 and a position arrangement of fifteen pins is the same as that of a 15-pin high-density D-SUB male connector.

According to another embodiment of the present invention, an electrical connector comprises a group of first electrical terminals and at least one second electrical terminal. The group of first electrical terminals is arranged in three rows, and the first electrical terminals in one of the three rows are separate from each other in a first pitch. The second electrical terminal is separate from an outmost first electrical terminal in the group of first electrical terminals in a second pitch.

According to another embodiment of the present invention, a cable comprises a transmitting line, a set of computer connectors and a combination connector. The set of computer connectors connects between the computer and the transmitting line. The combination connector connects between the KVM switch and the transmitting line to transmit keyboard signals, mouse signals, and video signals. The combination connector comprises a substrate and a plurality of pins mounted on the substrate. The number of the pins is greater than 15, and the position arrangement of fifteen of the pins is the same as that of a 15-pin high-density D-SUB male connector.

It is to be understood that both the foregoing general description and the following detailed description are examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
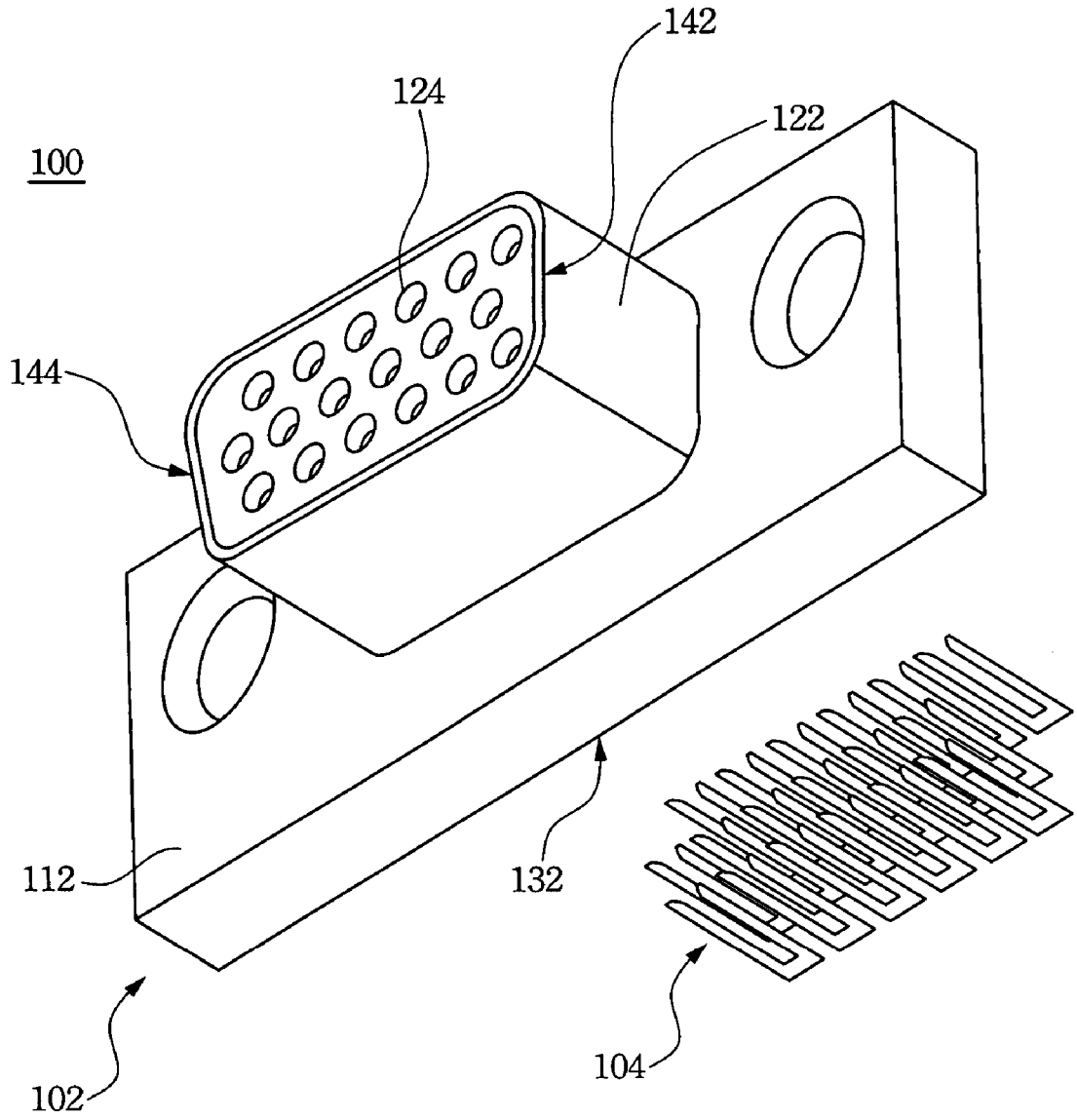
FIG. 1 is an exploded, perspective view of an electrical female connector according to one embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is an exploded, perspective view of an electrical female connector according to one embodiment of the present invention. An electrical female connector 100 has an insulative housing 102 and contacts 104. The insulative housing 102 includes a base portion 112, a mating portion 122 and passageways 124. The base portion 112 defines a rear terminating face 132. The mating portion 122 extends from the base portion 112 with a predetermined height and shape for coupling a complementary connector, for example, plugging into a shell of the complementary connector. Two opposite sides 144 and 142 of the mating portion 122 are not parallel and have different lengths. That is, the side 144 of the mating portion 122 is the same as that of a 15-pin high-density D-SUB female connector, and another side 142 of the mating portion 122 is extended more outwardly than that of the 15-pin high-density D-SUB female connector. The passageways 124 extend through the rear terminating face 132, the base portion 112 and the mating portion 122 in the front-to-back direction. The contacts 104 are received in the passageways 124, respectively, and the contacts 104 are adapted for electrically connecting a complementary connector (not shown) which mates with the electrical female connector 100.

Figure 2:
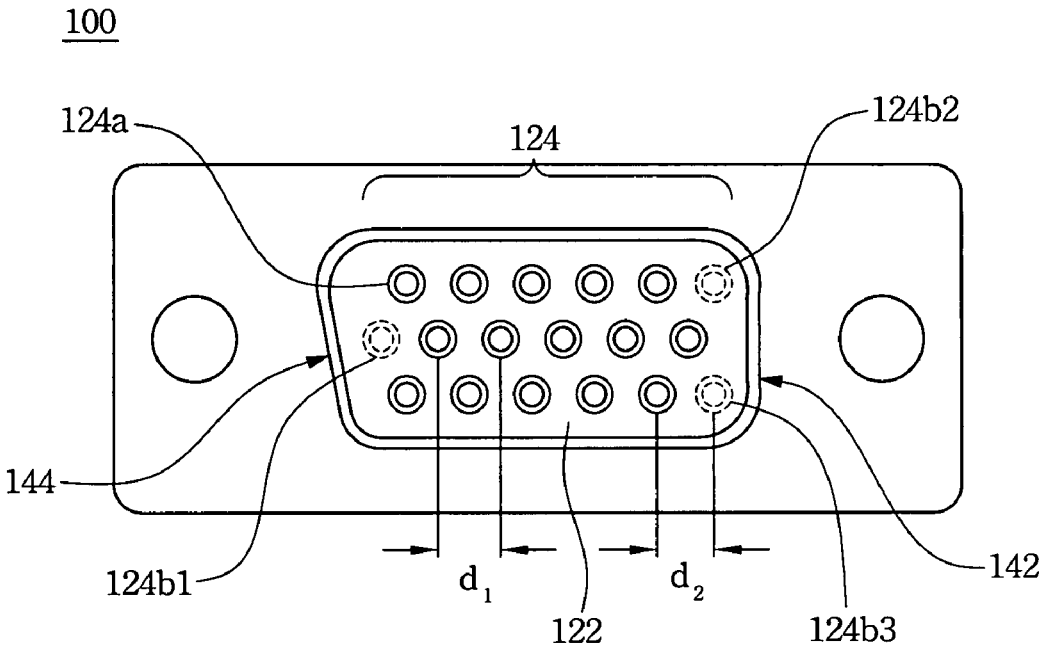
FIG. 2 is a front view of the electrical female connector of FIG. 1.

FIG. 2 is a front view of the electrical female connector 100 of FIG. 1. The slope of the side 144 is the same as that of one side of the 15-pin high-density D-SUB female connector, but the slope of the side 142 is different from that of the other side of the 15-pin high-density D-SUB female connector. More precisely, compared to the 15-pin high-density D-SUB female connector, the mating portion 122 extends the side 142 more outwardly to increase the surface area thereof so as to accommodate more passageways 124.

In this embodiment, the number of the passageways 124 is 18. However, the number of the passageways 124 can be 16 or 17 in order to meet the requirements of different applications according to other embodiments of the present invention. In some examples, the design illustrated here may increase the pin density and provide a pin density that is higher than a typical 15-pin high-density D-SUB connector. Moreover, the passageways 124 are arranged in three parallel rows, and the position arrangement of fifteen of the passageways 124*a* (solid circle) is the same as that of the 15-pin high-density D-SUB female connector. That is, the fifteen passageways 124*a* can respectively correspond to the fifteen passageways of the 15-pin high-density D-SUB female connector.

The rest of the passageways 124 excluding the fifteen passageways 124*a*, i.e. the passageways (dash circle) 124*b*1, 124*b*2 and 124*b*3, are disposed in an extending region of the mating portion 122 compared with a mating portion of the 15-pin high-density D-SUB female connector. Referring to FIG. 2, each of the passageways 124*b*1 to 124*b*3 is disposed in one of the three parallel rows, and is disposed in the position where the passageways of the 15-pin high-density D-SUB female connector have never occupied. In one embodiment, the passageways 124*b*1 to 124*b*3 are disposed in the three parallel rows, respectively.

In addition, the contacts 104 shown in FIG. 1 in the same position arrangement of the 15-pin high-density D-SUB female connector, which are received in the passageways 124*a*, are provided to transmit video signals; and the rest of the contacts 104, which are received in the passageways 124*b*1 to 124*b*3, can be provided to transmit audio signals, keyboard signals, mouse signals or other digital signals.

In other words, the electrical terminals (e.g. the contacts 104) of the electrical female connector 100 may be divided into two or more groups. Referring to FIG. 2 as an example, the electrical female connector 100 has a group of first contacts 104 received in the passageways 124*a* (solid circle) and a group of second contacts 104 received in the passageways 124*b*1 to 124*b*3 (dash circle).

The contacts 104 received in the passageways 124*a*, which include fifteen contacts 104 in this example, belong to the group of first contacts, which are arranged in three rows. In one example, the group of second contacts 104 received in the passageways 124*b*1 to 124*b*3 may include the right-most contacts 104 received in the passageway 124*b*2 in the first row and the passageway 124*b*3 in the third row, respectively, and the left-most contact 104 received in the passageway 124*b*1 in the second row.

The first contacts, each of which is received in one of the passageways 124*a* in the three rows, may be separated from each other with approximately the same pitch (first pitch) d1, which may be approximately 2.29 mm in one example. The second contact, each of which is received in the passageways 124*b*1 to 124*b*3, may be separated from the closest first contact received in the passageway 124*a* with a smaller pitch (second pitch) d2, which may be approximately 2.07 mm in one example. In this example, the second pitch d2 is smaller than the first pitch d1. However, depending on the application, the second pitch d2 can be equal to or larger than the first pitch d1.

Figure 3:
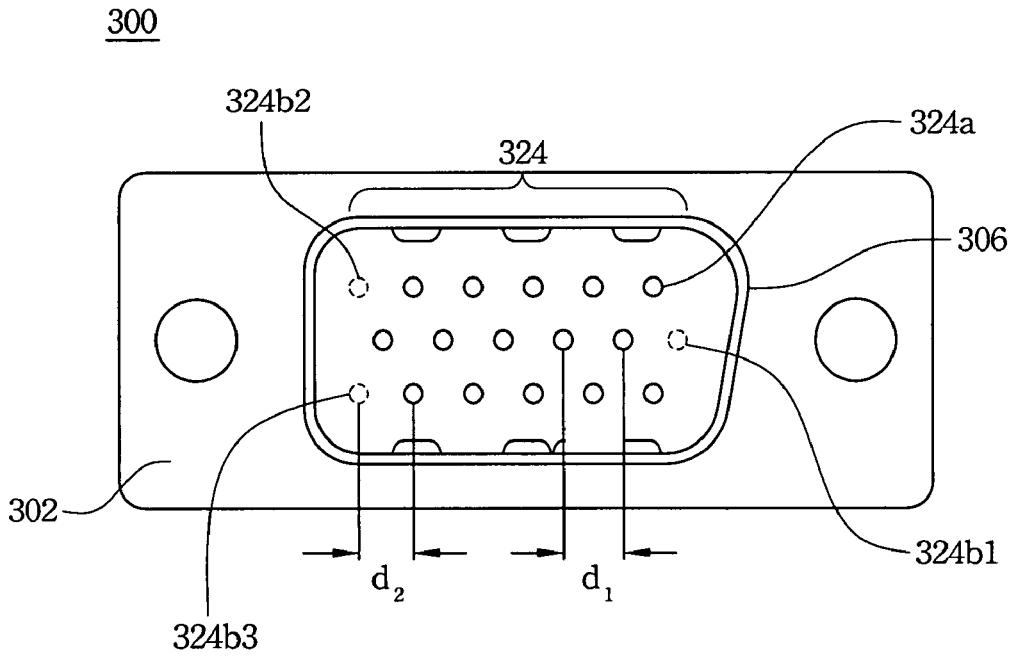
FIG. 3 is a front view of an electrical male connector according to another embodiment of the present invention.

FIG. 3 is a front view of an electrical male connector according to another embodiment of the present invention. The electrical male connector 300 has a substrate 302 and pins 324. The pins 324 are mounted on the substrate 302. The number of the pins 324 is greater than 15, and the position arrangement of fifteen of the pins 324 is the same as that of a 15-pin high-density D-SUB male connector.

In this embodiment, the number of the pins 324 is 18. However, the number of the pins 324 can be 16 or 17 in order to meet the requirements of different applications according to other embodiments of the present invention. Moreover, the pins 324 are arranged in three parallel rows, and the position arrangement of fifteen of the pins 324*a* (solid circle) is the same as that of the 15-pin high-density D-SUB male connector. That is, the fifteen pins 324*a* can respectively correspond to the fifteen pins of the 15-pin high-density D-SUB male connector.

The rest of the pins 324 excluding the fifteen pins 324*a*, i.e. the pins (dash circle) 324*b*1 to 324*b*3, are disposed in an extending region compared with the 15-pin high-density D-SUB male connector. Referring to FIG. 3, each of the pins 324*b*1 to 324*b*3 is disposed in one of the three parallel rows, and is disposed in the position where the pins of the 15-pin high-density D-SUB male connector have never occupied. In one embodiment, the pins 324*b*1 to 324*b*3 are disposed in the three parallel rows, respectively.

In addition, the pins 324*a* in the same position arrangement of the 15-pin high-density D-SUB male connector are provided to transmit video signals; and the rest of the pins 324, i.e. the pins 324*b*1 to 324*b*3, can be provided to transmit audio signals, keyboard signals, mouse signals or other digital signals. However, in practice, persons skilled in the art can arbitrarily assign the pins 324 to transmit the video signals, audio signals, keyboard signals, mouse signals or other digital signals, not limited by the embodiment as described above.

In other words, the electrical terminals (e.g. the pins 324) of the electrical male connector 300 may be divided into two or more groups. Referring to FIG. 3 as an example, the electrical male connector 300 has a group of first pins 324*a* (solid circle), a group of second pins 324*b*1 to 324*b*3 (dash circle), and a shield 306. The group of first pins 324*a* is arranged in three rows. In one example, the group of second pins 324*b*1 to 324*b*3 may include the left-most pin 324*b*2 in the first row and the left-most pin 324*b*3 in the third row, and the right-most pin 324*b*1 in the second row.

Each of the first pins 324*a* in the three rows may be separated from each other with approximately the same pitch (first pitch) d1, which may be approximately 2.29 mm in one example. Each of the second pins 324*b*1 to 324*b*3 may be separated from the closest first pin 324*a* with a smaller pitch (second pitch) d2, which may be approximately 2.07 mm in one example. In this example, the second pitch d2 is smaller than the first pitch d1. However, depending on the application, the second pitch d2 can be equal to or larger than the first pitch d1. The shield 306 surrounding the group of first pins 324*a* and the group of the second pins 324*b*1 to 324*b*3 may have a dimension (i.e. in its length×width) of approximately 8.36 mm×17.15 mm.

Figure 4:
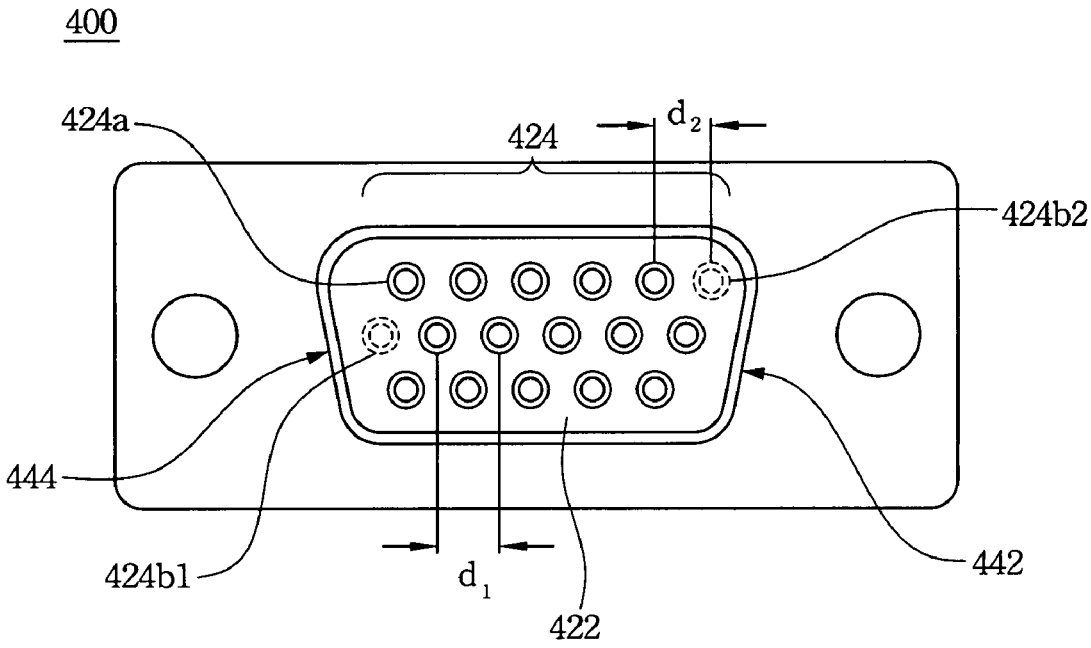
FIG. 4 is a front view of an electrical female connector according to another embodiment of the present invention.

FIG. 4 is a front view of the electrical female connector according to one embodiment of the present invention. The slope of the side 444 is the same as that of one side of the 15-pin high-density D-SUB female connector, and the slope of the side 442 is also the same as that of the other side of the 15-pin high-density D-SUB female connector. More precisely, compared to the 15-pin high-density D-SUB female connector, the mating portion 422 extends the side 442 more outwardly to increase the surface area thereof so as to accommodate more passageways 424.

In this embodiment, the number of the passageways 424 is 17. However, the number of the passageways 424 can be 16 in order to meet the requirements of different applications according to other embodiments of the present invention. In some examples, the design illustrated here may increase the pin density and provide a pin density that is higher than a typical 15-pin high-density D-SUB connector. Moreover, the passageways 424 are arranged in three parallel rows, and the position arrangement of fifteen of the passageways 424*a* (solid circle) is the same as that of the 15-pin high-density D-SUB female connector. That is, the fifteen passageways 424*a* can respectively correspond to the fifteen passageways of the 15-pin high-density D-SUB female connector.

The rest of the passageways 424 excluding the fifteen passageways 424*a*, i.e. the passageways (dash circle) 424*b*1 and 424*b*2, are disposed in an extending region of the mating portion 422 compared with a mating portion of the 15-pin high-density D-SUB female connector. The passageways 424*b*1 and 424*b*2 are disposed in the position where the passageways of the 15-pin high-density D-SUB female connector have never occupied.

In addition, the contacts in the same position arrangement of the 15-pin high-density D-SUB female connector, which are received in the passageways 424*a*, are provided to transmit video signals; and the rest of the contacts, which are received in the passageways 424*b*1 and 424*b*2, can be provided to transmit audio signals, keyboard signals, mouse signals or other digital signals.

In other words, the electrical terminals (e.g. the contacts) of the electrical female connector 400 may be divided into two or more groups. Referring to FIG. 4 as an example, the electrical female connector 400 has a group of first contacts received in the passageways 424*a* (solid circle) and a group of second contacts received in the passageways 424*b*1 and 424*b*2 (dash circle).

The contacts received in the passageways 424*a*, which include fifteen contacts in this example, belong to the group of first contacts, which are arranged in three rows. In one example, the group of second contacts received in the passageways 424*b*1 and 424*b*2 may include the right-most contact received in the passageway 424*b*2 in the first row, and the left-most contact received in the passageway 424*b*1 in the second row.

The first contacts, each of which is received in one of the passageways 424*a* in the three rows, may be separated from each other with approximately the same pitch (first pitch) d1, which may be approximately 2.29 mm in one example. The second contact, each of which is received in the passageways 424*b*1 and 424*b*2, may be separated from the closest first contact received in the passageway 424*a* with a smaller pitch (second pitch) d2, which may be approximately 2.07 mm in one example. In this example, the second pitch d2 is smaller than the first pitch d1. However, depending on the application, the second pitch d2 can be equal to or larger than the first pitch d1.

Figure 5:
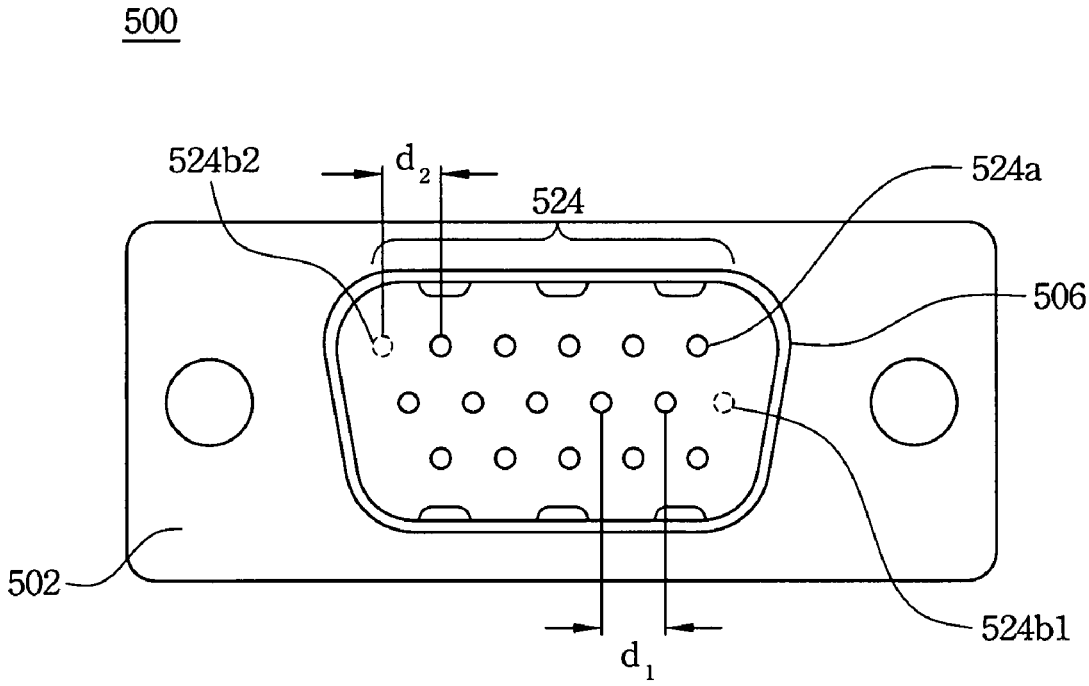
FIG. 5 is a front view of an electrical male connector according to another embodiment of the present invention.

FIG. 5 is a front view of an electrical male connector according to another embodiment of the present invention. The electrical male connector 500 has a substrate 502 and pins 524. The pins 524 are mounted on the substrate 502. The number of the pins 524 is greater than 15, and the position arrangement of fifteen of the pins 524 is the same as that of a 15-pin high-density D-SUB male connector.

In this embodiment, the number of the pins 524 is 17. However, the number of the pins 524 can be 16 in order to meet the requirements of different applications according to other embodiments of the present invention. Moreover, the pins 524 are arranged in three parallel rows, and the position arrangement of fifteen of the pins 524*a* (solid circle) is the same as that of the 15-pin high-density D-SUB male connector. That is, the fifteen pins 524*a* can respectively correspond to the fifteen pins of the 15-pin high-density D-SUB male connector.

The rest of the pins 524 excluding the fifteen pins 524*a*, i.e. the pins (dash circle) 524*b*1 and 524*b*2, are disposed in an extending region compared with the 15-pin high-density D-SUB male connector. The pins 524*b*1 and 524*b*3 are disposed in the position where the pins of the 15-pin high-density D-SUB male connector have never occupied.

In addition, the pins 524*a* in the same position arrangement of the 15-pin high-density D-SUB male connector are provided to transmit video signals; and the rest of the pins 524, i.e. the pins 524*b*1 and 524*b*2, can be provided to transmit audio signals, keyboard signals, mouse signals or other digital signals.

In other words, the electrical terminals (e.g. the pins 524) of the electrical male connector 500 may be divided into two or more groups. Referring to FIG. 5 as an example, the electrical male connector 500 has a group of first pins 524*a* (solid circle), a group of second pins 524*b*1 and 524*b*2 (dash circle), and a shield 506. The group of first pins 524*a* is arranged in three rows. In one example, the group of second pins 524*b*1 and 524*b*2 may include the left-most pin 524*b*2 in the first row, and the right-most pin 524*b*1 in the second row.

Each of the first pins 524*a* in the three rows may be separated from each other with approximately the same pitch (first pitch) d1, which may be approximately 2.29 mm in one example. Each of the second pins 524*b*1 and 524*b*2 may be separated from the closest first pin 524*a* with a smaller pitch (second pitch) d2, which may be approximately 2.07 mm in one example. In this example, the second pitch d2 is smaller than the first pitch d1. However, depending on the application, the second pitch d2 can be equal to or larger than the first pitch d1. The shield 506 surrounding the group of first pins 524*a* and the group of the second pins 524*b*1 and 524*b*2 may have a dimension (i.e. in its length×width) of approximately 8.36 mm×17.15 mm.

Figure 6A:
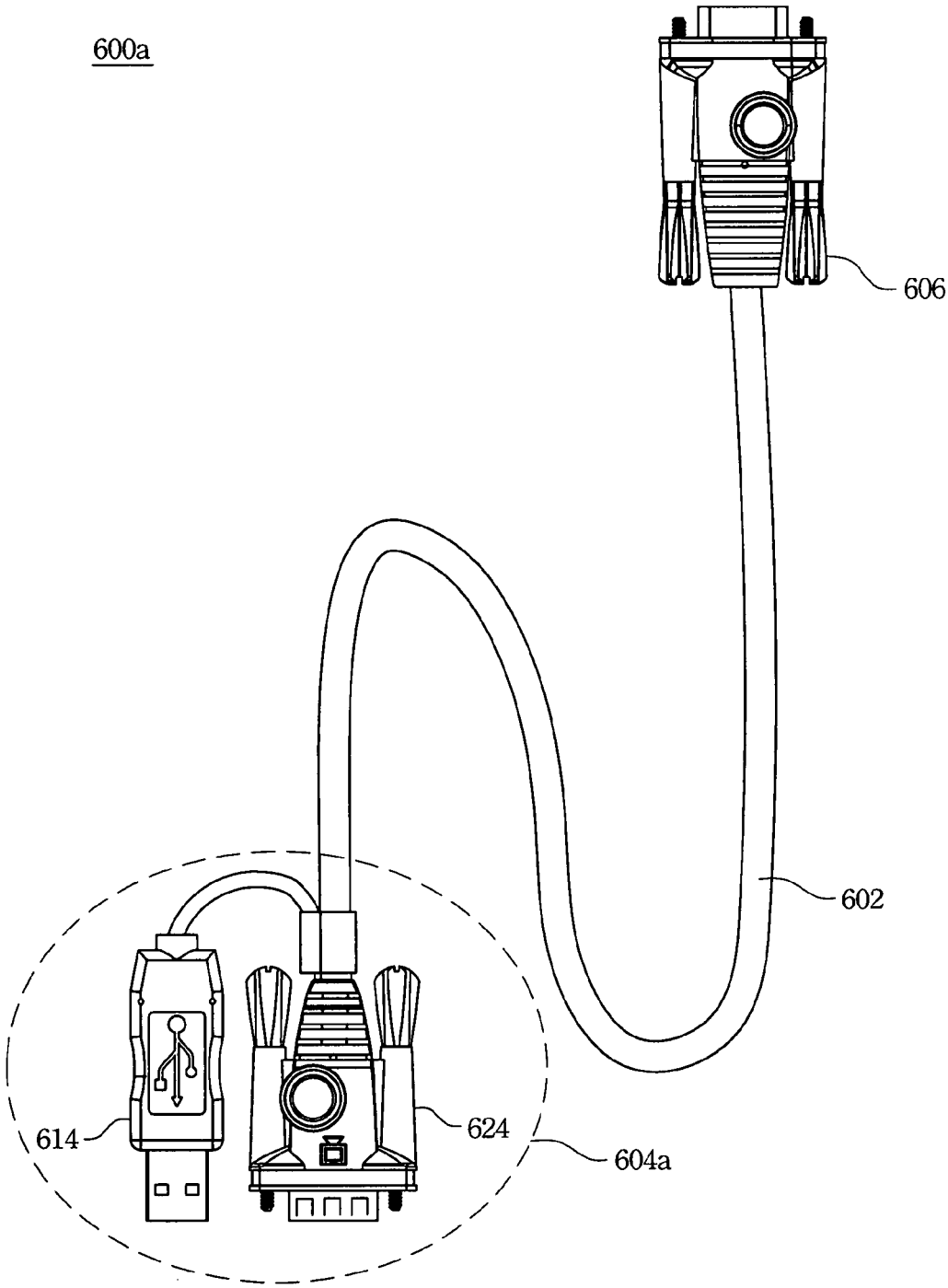
FIGS. 6A-6C illustrate cables according to embodiments of the present invention, which may be provided for connecting a computer to a KVM switch, respectively.

FIG. 6A illustrates a cable 600*a* according to one embodiment of the present invention, which may be provided for connecting a computer to a KVM switch, for example. The cable 600*a* has a transmitting line 602, a set of computer connectors 604*a* and a combination connector 606. The set of computer connectors 604*a* connects between the computer (not illustrated) and the transmitting line 602. The combination connector 606 connects between the KVM switch (not illustrated) and the transmitting line 602 to transmit keyboard signals, mouse signals, and video signals.

The set of computer connectors 604*a* includes a USB connector 614 and a monitor connector 624. The monitor connector 624 can be a typical connector for coupling a monitor, such as a VGA HDB15 connector or other suitable monitor connector. The USB connector 614 can be a typical USB connector, such as a type A USB connector or other suitable USB connector. When the cable 600*a* receives the mouse and keyboard PS/2 signals from the KVM switch via the transmitting line 602, a signal converting device (not illustrated) integrated in one of the transmitting line 602, the combination connector 606 and the set of the computer connectors 604*a* may convert the mouse and keyboard PS/2 signals into USB signals for the computer coupled to the set of the computer connectors 604*a*. In this embodiment, the USB connector 614 may convert the mouse and keyboard PS/2 signals into USB signals for the computer coupled thereto. The monitor connector 624 transmits the video signals to the KVM switch via the transmitting line 602.

Figure 6B:
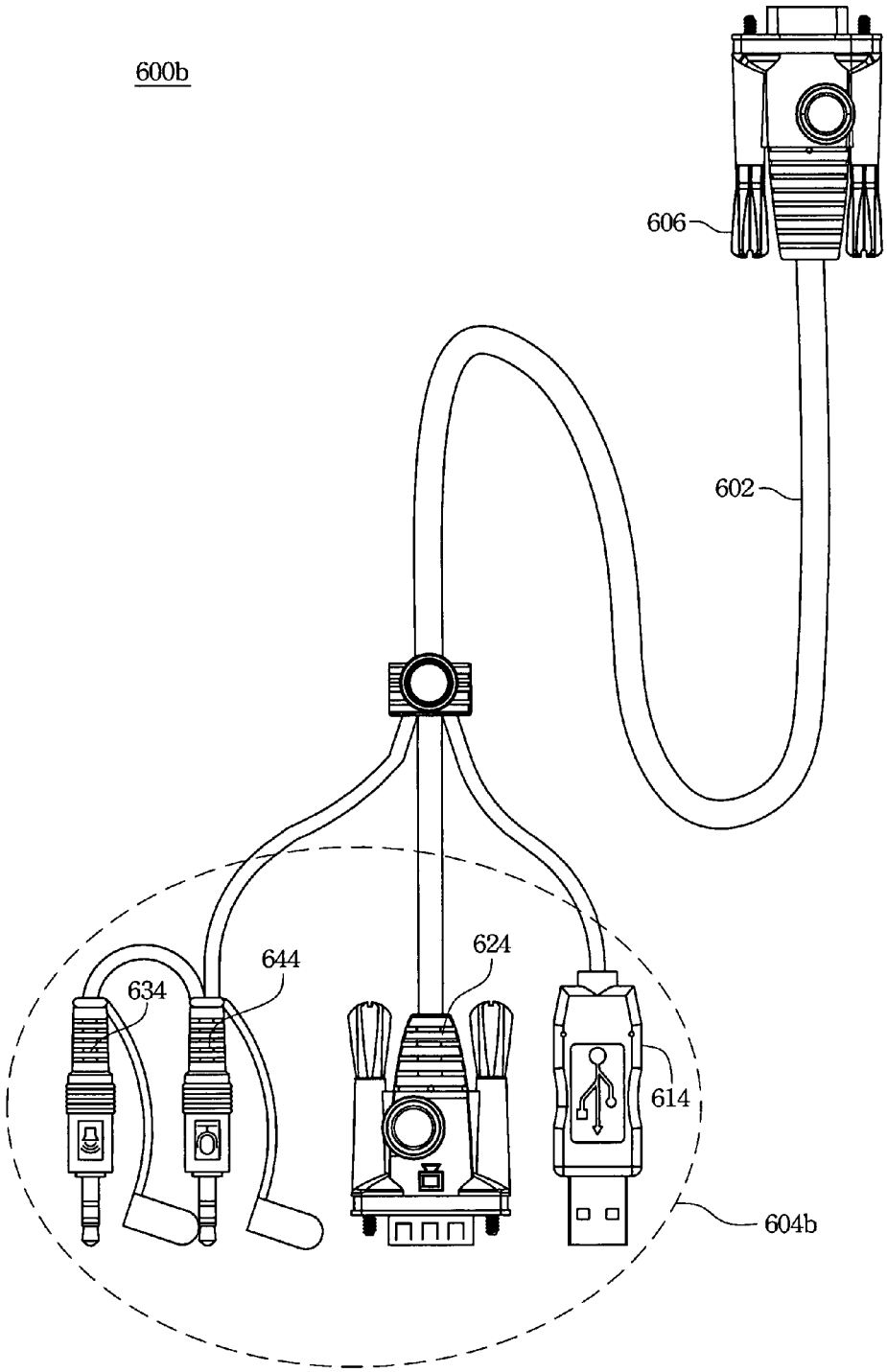

FIG. 6B illustrates a cable 600*b* according to another embodiment of the present invention, which may be provided for connecting a computer to a KVM switch, for example. The cable 600*b* has a transmitting line 602, a set of computer connectors 604*b* and a combination connector 606. The set of computer connectors 604*b* connects between the computer (not illustrated) and the transmitting line 602. The combination connector 606 connects between the KVM switch (not illustrated) and the transmitting line 602 to transmit keyboard signals, mouse signals, and video signals.

The set of computer connectors 604*b* includes a speaker connector 634 and a microphone connector 644 in addition to the USB connector 614 and the monitor connector 624 as described above. The speaker connector 634 can transmit audio signals for a speaker, and the microphone connector 644 can transmit audio signals for a microphone, such as provided from an audio interface configured on the computer.

Figure 6C:
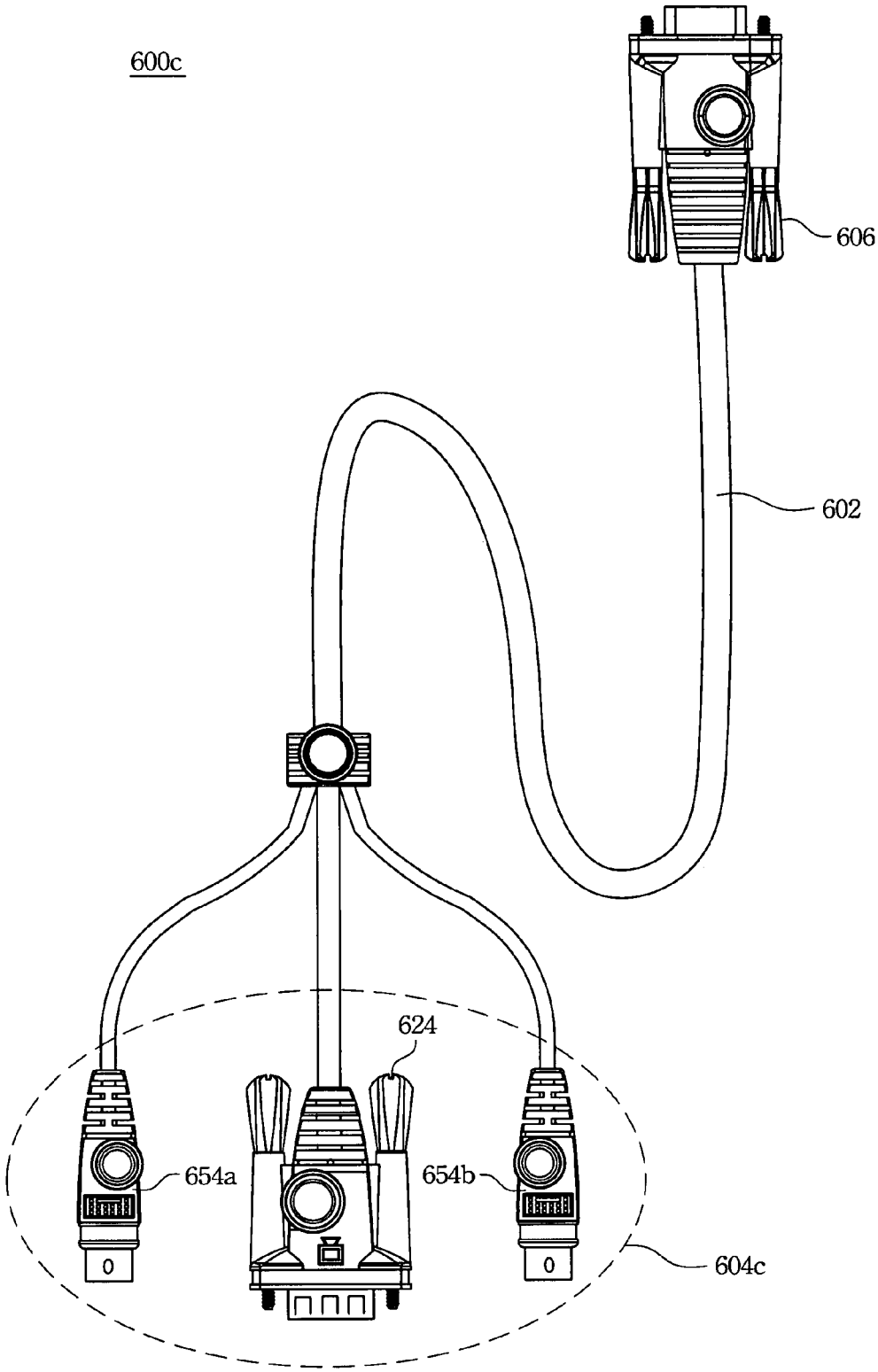

FIG. 6C illustrates a cable 600*c* according to another embodiment of the present invention, which may be provided for connecting a computer to a KVM switch, for example. The cable 600*c* has a transmitting line 602, a set of computer connectors 604*c* and a combination connector 606. The set of computer connectors 604*c* connects between the computer (not illustrated) and the transmitting line 602. The combination connector 606 connects between the KVM switch (not illustrated) and the transmitting line 602 to transmit keyboard signals, mouse signals, and video signals.

The set of computer connectors 604*c* includes at least one PS/2 connector, such as a keyboard PS/2 connector 654*a* and a mouse PS/2 connector 654*b*, and the monitor connector 624 as described above. When the cable 600*c* receives the mouse and keyboard USB signals from the KVM switch via the transmitting line 602, a signal converting device (not illustrated) integrated in one of the transmitting line 602, the combination connector 606 and the set of the computer connectors 604*c* may convert the mouse and keyboard USB signals into PS/2 signals for the computer coupled to the set of the computer connectors 604*c*. In this embodiment, the PS/2 connectors 654*a*, 654*b* may convert the mouse and keyboard USB signals into PS/2 signals for the computer coupled thereto. It is to be understood that the keyboard PS/2 connector 654*a* and the mouse PS/2 connector 654*b* may be configured to arrange in one side of the monitor connector 624.

More particularly, the signal converting device may have a compact size, for example, constructed by a semiconductor chip. Therefore, the signal converting device can be configured in any place of the cable 600*a* or 600*c* to convert the signals. That is, the signal converting device can be integrated in the set of computer connectors, or the combination connector, or the transmitting line, thus not increasing the appearance dimensions and volume thereof.

Figure 7:
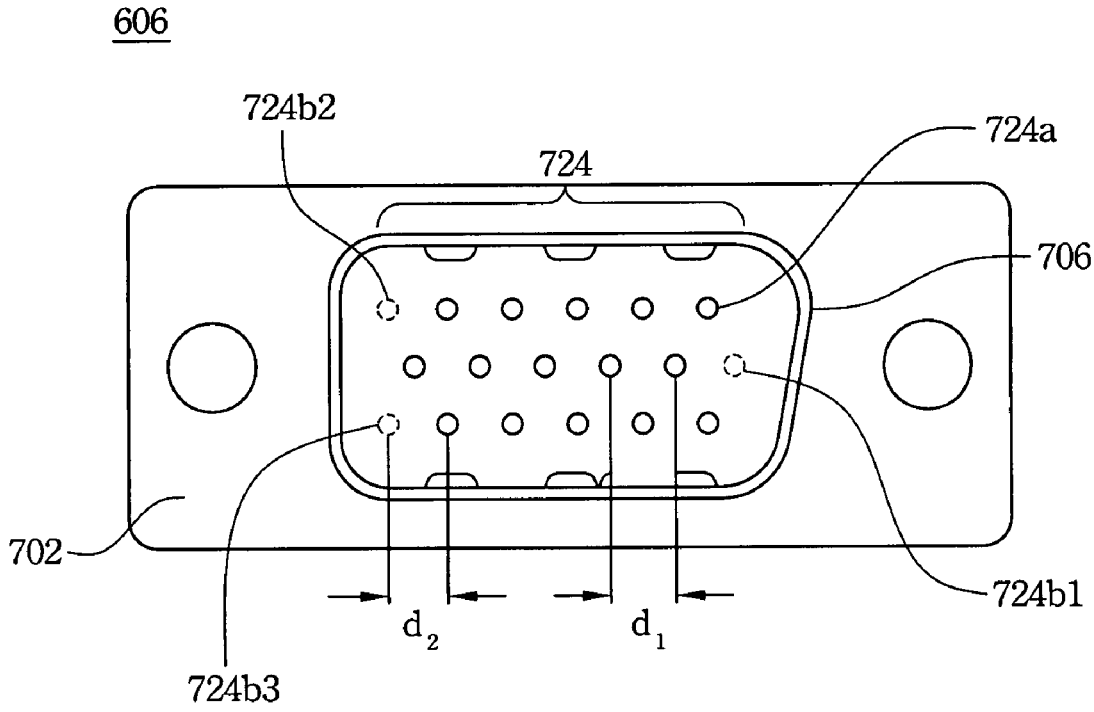
FIG. 7 illustrates the combination connector utilized in FIGS. 6A-6C.

FIG. 7 illustrates the combination connector 606 in FIGS. 6A-6C. The combination connector 606 has a substrate 702 and pins 724. The pins 724 are mounted on the substrate 702. The number of the pins 724 is greater than 15, and the position arrangement of fifteen of the pins 724 is the same as that of a 15-pin high-density D-SUB male connector.

In this embodiment, the number of the pins 724 is 18. However, the number of the pins 724 can be 16 or 17 in order to meet the requirements of different applications according to other embodiments of the present invention. The pins 724 may be divided into two or more groups. Referring to FIG. 7 as an example, the combination connector 606 has a group of first pins 724*a* (solid circle), a group of second pins 724*b*1 to 724*b*3 (dash circle), and a shield 706.

Each of the first pins 724*a*, which are arranged in three rows, may be separated from each other with approximately the same pitch (first pitch) d1, which may be approximately 2.29 mm in one example. Each of the second pins 724*b*1 to 724*b*3 may be separated from the closest first pin 724*a* with a smaller pitch (second pitch) d2, which may be approximately 2.07 mm in one example. In this example, the second pitch d2 is smaller than the first pitch d1. However, depending on the application, the second pitch d2 can be equal to or larger than the first pitch d1. The shield 706 surrounding the group of first pins 724*a* and the group of the second pins 724*b*1 to 724*b*3 may have a dimension (i.e. in its length×width) of approximately 8.36 mm×17.15 mm.

In conclusion, the electrical connectors provided by the above embodiments, the electrical female connector or the electrical male connector, can provide more terminals to transmit various kinds of signals provided for different functions in addition to video displaying, thus increasing the extensibility and flexibility of the D-SUB connector.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electrical male connector, comprising:

a substrate; and a plurality of pins mounted on the substrate, wherein a number of the pins is greater than 15, and a position arrangement of fifteen of the pins is the same as that of a 15-pin high-density D-SUB male connector, wherein the fifteen pins in the same position arrangement of the 15-pin high-density D-SUB male connector are provided to transmit video signals, and the rest of the pins are provided to transmit audio signals, keyboard signals, mouse signals or digital signals.

2. The electrical male connector of claim 1, wherein a number of the pins is 16, 17 or 18.

3. The electrical male connector of claim 1, wherein the pins are arranged in three parallel rows.

4. An electrical female connector, comprising:

an insulative housing comprising:

a base portion having a rear terminating face;

a mating portion extending from the base portion, wherein two opposites sides of the mating portion are not parallel and have different lengths;

a plurality of passageways in excess of fifteen, extending through the rear terminating face and the mating portion; and a plurality of contacts received in the passageways, respectively, wherein a position arrangement of fifteen of the passageways is the same as that of a 15-pin high-density D-SUB female connector and are provided to transmit video signals, and at least one of rest of the passageways are provided to transmit audio signals, keyboard signals, mouse signals or digital signals, wherein the contacts are adapted for electrically connecting a complementary connector.

5. The electrical female connector of claim 4, wherein a number of the passageways is 16, 17 or 18.

6. The electrical female connector of claim 4, wherein the passageways are arranged in three parallel rows.

7. The electrical female connector of claim 4, wherein the at least one of the rest of the passageways excluding the fifteen passageways is disposed in an extending region of the mating portion compared with a mating portion of the 15-pin high density D-SUB female connector.

8. An electrical connector, comprising:

an insulative housing having a keyed mating portion which extends from a base portion, further comprising:

at least two groups of electrical terminals, wherein a first group of electrical terminals are arranged in three linear rows, wherein each row comprises a plurality of electrical terminals, each electrical terminal in the first group having a first pitch identical to every other electrical terminals in the first group within each respective row; and a second group of electrical terminals comprising at least one electrical terminal, wherein at least one of the electrical terminal in the second group is linearly aligned with one of the three rows defined by the first group of electrical terminals, the second group of the electrical terminal having a second pitch different from the first pitch of the first group of electrical terminals.

9. The electrical connector of claim 8, wherein the connector further comprises:

a shield, surrounding the group of the first electrical terminals and the second electrical terminal.

10. The electrical connector of claim 8, wherein a number of the group of the first electrical terminals is 15.

11. The electrical connector of claim 8, wherein the second pitch is smaller than the first pitch.

12. The electrical connector of claim 8, wherein the first pitch is about 2.29 mm.

13. The electrical connector of claim 8, wherein the second pitch is about 2.07 mm.

14. A cable for connecting a computer to a KVM switch, the cable comprising:

a transmitting line;

a set of computer connectors connecting between the computer and the transmitting line; and a combination connector connecting between the KVM switch and the transmitting line to transmit keyboard signals, mouse signals, and video signals, wherein the combination connector comprises:

a substrate; and a plurality of pins mounted on the substrate, wherein a number of the pins is greater than 15, and a position arrangement of fifteen of the pins is the same as that of a 15-pin high-density D-SUB male connector.

15. The cable of claim 14, wherein the set of computer connectors further comprises a speaker connector to transmit audio signals for a speaker.

16. The cable of claim 14, wherein the set of computer connectors further comprises a microphone connector to transmit audio signals for a microphone.

17. The cable of claim 14, wherein the set of computer connectors further comprises a USB connector.

18. The cable of claim 14, wherein the set of computer connectors further comprises a PS/2 connector.

19. The cable of claim 14, further comprising:

a signal converting device integrated in one of the transmitting line, the combination connector and the set of the computer connectors, the signal converting device converting first signals into second signals.

20. The cable of claim 14, wherein the set of computer connectors further comprises a monitor connector.

21. The cable of claim 20, wherein the monitor connector is a VGA HDB 15 connector.

22. The cable of claim 19, wherein the first signals and the second signals are USB signals and PS/2 signals, respectively.

23. The cable of claim 19, wherein the first signals and the second signals are PS/2 signals and USB signals, respectively.

* * * * *